US006349458B1

(12) United States Patent
Al-Rawi

(10) Patent No.: US 6,349,458 B1
(45) Date of Patent: Feb. 26, 2002

(54) BURNISHING APPARATUS

(76) Inventor: Steven Al-Rawi, c/o BI Technologies Corporation, 4200 Bonita Pl., Fullerton, CA (US) 92635

( * ) Notice: Subject to any disclaimer, the term of this patent is extended or adjusted under 35 U.S.C. 154(b) by 0 days.

(21) Appl. No.: 09/384,891

(22) Filed: Aug. 27, 1999

(51) Int. Cl.[7] ..... B21C 37/30
(52) U.S. Cl. ..... 29/90.01; 72/75
(58) Field of Search ..... 29/90.01, 597; 72/76, 75, 89; 451/291; 74/570; 384/604, 613, 609, 590

(56) References Cited

U.S. PATENT DOCUMENTS

| | | | | | |
|---|---|---|---|---|---|
| 391,725 | A | | 10/1888 | Trowbridge | |
| 845,730 | A | * | 2/1907 | Marshall | 29/90.01 |
| 921,739 | A | * | 5/1909 | Rieske | 72/89 |
| 961,140 | A | * | 6/1910 | Ketchum | 384/608 |
| 1,058,856 | A | * | 4/1913 | Gibbs | 72/75 |
| 1,318,194 | A | * | 10/1919 | Woodvine | 29/90.01 |
| 1,413,417 | A | * | 4/1922 | Moore | 74/570 |
| 1,513,084 | A | * | 10/1924 | Barbeau et al. | 74/570 |
| 1,842,571 | A | * | 1/1932 | Sebell | 72/75 |
| 1,867,981 | A | * | 7/1932 | Mudd | 74/50 |
| 2,218,928 | A | * | 10/1940 | Towler et al. | 74/55 |
| 2,378,838 | A | | 6/1945 | Comstock | |
| 2,400,590 | A | | 5/1946 | Meyerhoefer | |
| 2,527,725 | A | * | 10/1950 | Hartman | 29/90.01 |
| 2,861,483 | A | * | 11/1958 | Dosen | 72/75 |
| 2,953,047 | A | * | 9/1960 | Stillwagon | 72/75 |
| 2,967,283 | A | | 1/1961 | Medney | |
| 3,059,315 | A | * | 10/1962 | Chambers | 29/90.01 |
| 3,066,386 | A | | 12/1962 | Filipczak | |
| 3,414,970 | A | | 12/1968 | Yamaguchi et al. | |
| 3,448,504 | A | | 6/1969 | Dombrowski et al. | |
| 3,606,708 | A | | 9/1971 | Plichta et al. | |
| 3,820,210 | A | | 6/1974 | Kalen | |
| 4,466,165 | A | * | 8/1984 | Otto | 29/90.01 |
| 4,580,333 | A | | 4/1986 | Griffis | |
| 5,243,867 | A | * | 9/1993 | Polyak | 74/570 |
| 5,287,607 | A | | 2/1994 | Hongo | |
| 5,426,988 | A | * | 6/1995 | Ohata et al. | 74/55 |
| 5,554,018 | A | * | 9/1996 | Segers | 418/55.4 |
| 5,655,396 | A | * | 8/1997 | Siler | 72/75 |
| 5,779,426 | A | * | 7/1998 | Ishikawa et al. | 29/90.01 |

* cited by examiner

*Primary Examiner*—S. Thomas Hughes
*Assistant Examiner*—Marc Jimenez

(57) ABSTRACT

A burnishing apparatus is provided for burnishing a surface of a material. The burnishing apparatus includes a guide member having an annular groove which is eccentric to the rotating axis of the guide member. A rolling element is disposed between the groove and the surface of the material. The rolling element has a radius r, an effective rolling radius on the guide member $r_1$, and an effective rolling radius $r_2$ on the surface of the material, and $r=r_2$ and $r_1<r_2$. Due to the combined effects of an eccentric groove and $r_1<r_2$, a variable track is left on the surface of the material as the rolling element rolls along the groove and on the surface of the material. The variable track repeats after the rolling element revolves around the surface of the material N revolutions. The burnishing apparatus may further include an actuator which drives a top cover onto the material to force the surface of the material on the rolling element. The burnishing disk may be rotatively driven by a motor. When a plurality of rolling elements are used, the burnishing apparatus may further include a retainer for fixing the relative position of the rolling elements.

15 Claims, 11 Drawing Sheets

BURNISHING APPARATUS

FIELD OF THE INVENTION

The invention relates generally to ultra-low abrasion slip rings and method and apparatus for burnishing a surface of a material.

BACKGROUND OF THE INVENTION

There are many applications which require a smooth surface finish. One application requiring an ultra-low abrasion finish is a contact surface of a slip ring assembly. One of the problems associated with a slip ring assembly is that a contacting element such as a brush wears prematurely due to the roughness of the contact surface. The premature wear may be reduced by burnishing the contact surface.

Several devices are currently available to burnish a surface of a material. However, none of the devices thus far appear to be without problems. U.S. Pat. No. 3,606,708 to Plichta et al. discloses a burnishing apparatus for smoothing metal coated surfaces by successive rolling and burnishing operations. The apparatus performs rolling and burnishing operations using hard polished rollers and a flexible burnishing wheel. A workpiece is advanced through the rolling and burnishing stations by two opposed conveyor belts which grip the pieces therebetween with a portion to be rolled and burnished protruding to one side of the belts. However, due to the conveyor belt arrangement, it is difficult to selectively burnish an annular contact surface of a slip ring assembly without burnishing the entire surface of the slip ring assembly. In certain circumstances, the surface of the slip ring assembly may include various electrical components which should not or do not require burnishing.

U.S. Pat. No. 3,820,210 to Kalen discloses a burnishing tool which is more applicable to burnishing an annular contact surface. The burnishing tool has a head connected to a spindle which is rotatively driven. The head has an end face with balls, and a workpiece is burnished by driving and rotating the head and balls on the surface of the workpiece. The balls produce a circular burnished track having a width w. The burnishing operation may be spread to all points of the workpiece by advancing the head over the flat area of the workpiece. The workpiece is mounted on a lead screw-operated table and movement of the table during burnishing may form an eccentric burnishing path. However, it may be difficult to properly advance the workpiece to form a well defined annular burnished path when the width of the burnished path W is greater than the width w. This is particularly important for a slip ring assembly requiring tight processing tolerances due to the high density of electrical components on the surface of the assembly.

Thus, there remains a need for a burnishing apparatus that accurately and precisely forms ultra-low abrasions annular surfaces.

SUMMARY OF THE INVENTION

In accordance with the present invention, a burnishing apparatus burnishes a surface of a material using rolling elements. The burnishing apparatus is particularly suited for burnishing an annular path having a width greater than the track width of the rolling elements. Generally, in accordance with an exemplary illustrative embodiment of the present invention, the burnishing apparatus comprises a burnishing unit, a control unit, and a compressed air source unit.

The burnishing unit includes a burnishing assembly, a drive unit for rotating the burnishing assembly, a positioning/securing unit for properly aligning and securing the slip ring substrate onto the burnishing unit, and a pneumatic actuator for directing a predetermined force on the substrate such that the surface of the substrate is forced onto the rolling elements.

The burnishing assembly includes a burnishing disk, rolling elements such as burnishing balls, a pressure pad, and a top cover. The burnishing disk has a first and second annular groove on its surface. The first and second groove have a common center axis which is offset from the rotating axis of the burnishing disk. The first groove guides a first pair of burnishing balls, and the second groove guides a second pair of burnishing balls. The ball retainer is a disk-shaped element having a first and second pair of apertures for retaining the four burnishing balls. The substrate is positioned such that the surface with the slip ring faces the burnishing balls, and the substrate is secured to the burnishing unit by the positioning/securing unit. The pneumatic actuator directs the top cover onto the back side of the slip ring substrate and forces the surface with the slip ring onto the bearings. The drive unit includes a motor, and the motor is coupled to the burnishing disk.

The burnishing balls have a radius r, an effective rolling radius on the guide member $r_1$, and an effective rolling radius on the surface of the substrate $r_2$, and $r=r_2$ and $r_1<r_2$. Since $r_1<r_2$, the angular traverse of the burnishing balls on the surface of the substrate $\phi>$the angular traverse of the burnishing balls on the surface of the guide member. Due to the combined effects of the center axis of the grooves being offset from the rotating axis of the burnishing disk and $r_1<r_2$, a variable track is left on the surface of the substrate as the burnishing balls roll along the grooves and on the surface of the substrate. Since each groove has a pair of burnishing balls and each burnishing ball leaves a track width w, the entire surface of the slip ring is covered after the pair of burnishing balls complete N revolutions around the surface of the substrate. The various components of the burnishing assembly are configured so that the variable track repeats every N revolutions, wherein $N \cdot w$ is $\geqq W$ to burnish a ring of width W.

The control unit is coupled to the burnishing unit, and an operator may set the various processing parameters such as the load directed on the substrate by the pneumatic actuator, the rotation rate of the burnishing disk, and the number of revolutions N. The compressed air source unit supplies compressed air for operating the pneumatic actuator.

Other objects, features, and advantages of the present invention will become apparent from a consideration of the following detailed description.

DETAILED DESCRIPTION OF THE PREFERRED EMBODIMENTS

Figure 1:
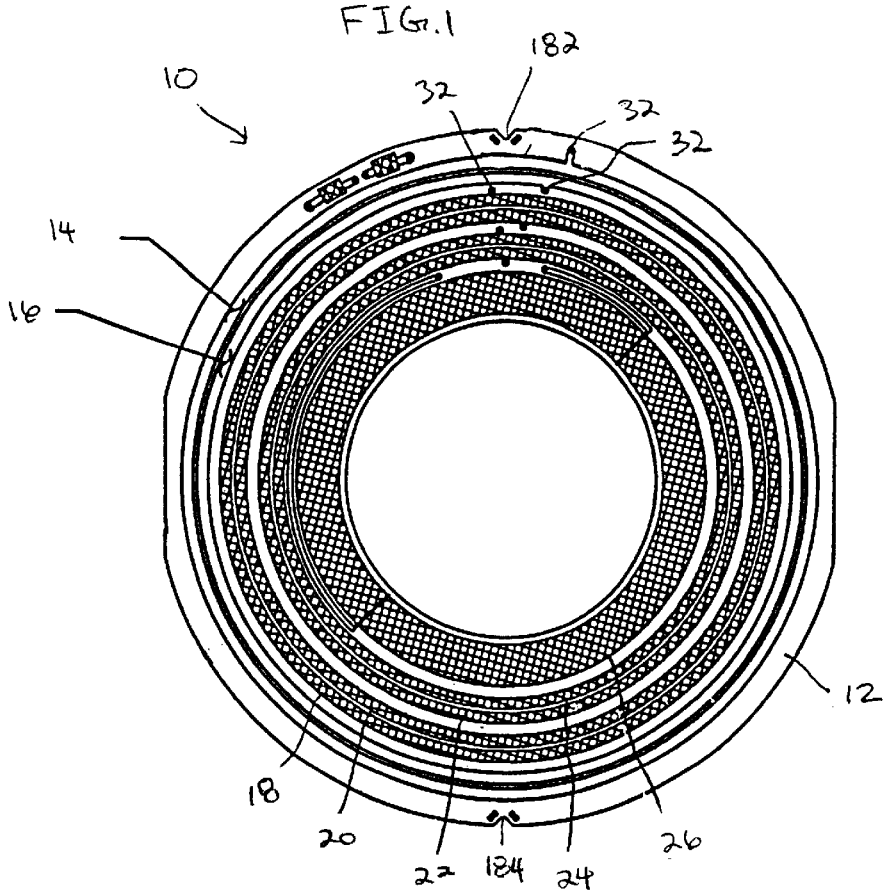
FIG. 1 is a top view of an exemplary slip ring substrate in accordance with the present invention.

The present invention relates to a burnishing apparatus for burnishing flat surfaces. In the particular embodiment shown in the drawings and herein described, the burnishing apparatus is designed to burnish thick film slip rings formed on an alumina substrate. However, it should be understood that the principles of the invention are equally applicable to virtually any material which has a flat surface. For example, the burnishing apparatus may be used to burnish the entire surface of a material or a semi-annular contact surface or the like. Therefore, the present invention should not be limited to the specific embodiment shown and such principles should be broadly construed.

Figure 2:
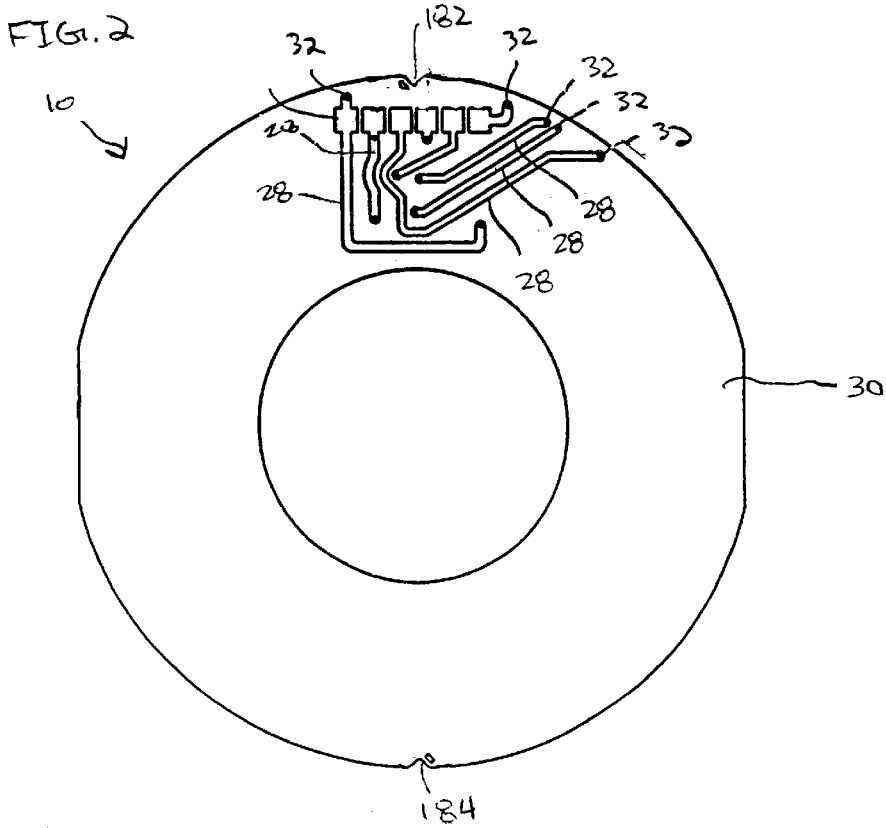
FIG. 2 is a bottom view of the slip ring substrate illustrated in FIG. 1.

Referring to FIGS. 1 and 2, an exemplary slip ring substrate 10 is illustrated for an angular-position sensing unit (not shown). The angular position sensing unit includes a circular potentiometer for determining an angular position of a shaft. The potentiometer comprises a position rotor, a plurality of position sensor brushes, and the slip ring substrate 10. The slip ring substrate 10 is formed from alumina and has a diameter of about three inches and a thickness of about forty mils. The front side 12 of the substrate 10 has a first 14 and second slip ring 16 and further includes a first 18, second 20, third 22, fourth 24, and fifth resistive ring 26. The slip rings 14, 16 and resistive rings 18, 20, 22, 24, 26 are formed using conventional thick film processes, wherein the slip 14, 16 and resistive rings 18, 20, 22, 24, 26 are screen patterned onto the front side 12 of the slip ring substrate 10, dried, and then fired. The slip rings 14, 16 are burnished to form a smooth surface to reduce wearing of the position sensor brushes as they slidingly contact the slip rings 14, 16. The resistive rings 18, 20, 22, 24, 26 are formed from a resistor ink blend. Each resistive ring 18, 20, 22, 24, 26 is electrically interconnected with the two slip rings 14, 16 when assembled into a sensor. The slip rings 14, 16 are used to conduct power to an additional resistor element (not shown).

Termination patterns 28 are formed on the back side 30 of the slip ring substrate 10. The termination patterns 28 interconnect the various components of the angular-position sensing unit such as the position sensor brushes, slip rings, and resistive rings with a controller. Each of the termination patterns 28 is electrically connected to their respective slip rings 14, 16 and resistive rings 18, 20, 22, 24, 26 by trough holes 32 formed through the slip ring substrate 10. The termination patterns 28 comprise silver ink screen printed onto the back side 30 of the slip ring substrate 10, dried and fired.

Figure 3:
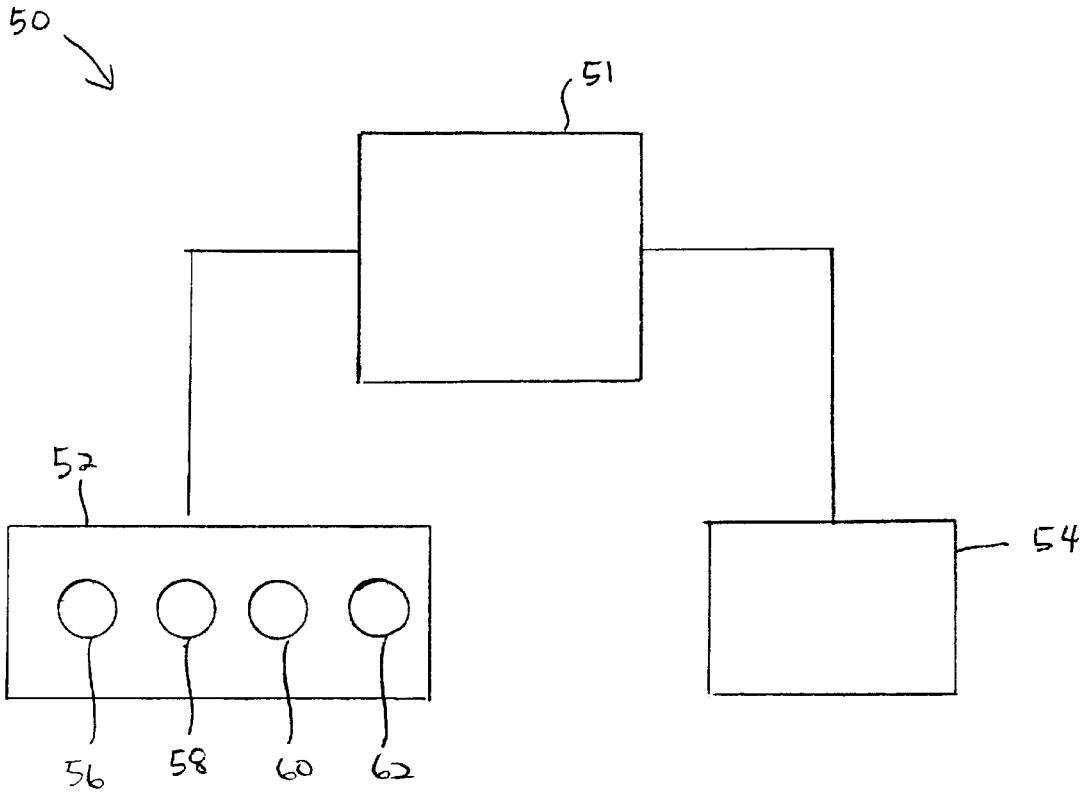
FIG. 3 is a block diagram illustrating the main components of a burnishing apparatus in accordance with the present invention.

Referring to FIG. 3, a block diagram of a burnishing apparatus 50 of the present invention is illustrated. The burnishing apparatus 50 includes a burnishing unit 51, a control unit 52, and a compressed air source unit 54. The burnishing unit 51 is configured to receive a substrate material such as a slip ring substrate, and includes a disk with a plurality of burnishing balls which roll on the slip ring of the substrate. The control unit 52 is coupled to the burnishing unit 51, and the control unit 52 includes a load selector 56 for selecting the appropriate load the burnishing unit 51 exerts on the slip ring substrate, a motor controller 58 for setting the rotation rate of the disk, a revolution selector 60 for selecting the number of revolutions the disk revolves during the burnishing cycle, and a gas flow rate selector 62 for selecting the flow rate of the gas used to clean the substrate during the burnishing process. The compressed air source unit 54 supplies compressed air for operating a pneumatic actuator which drives the substrate onto the burnishing balls.

Figure 4:
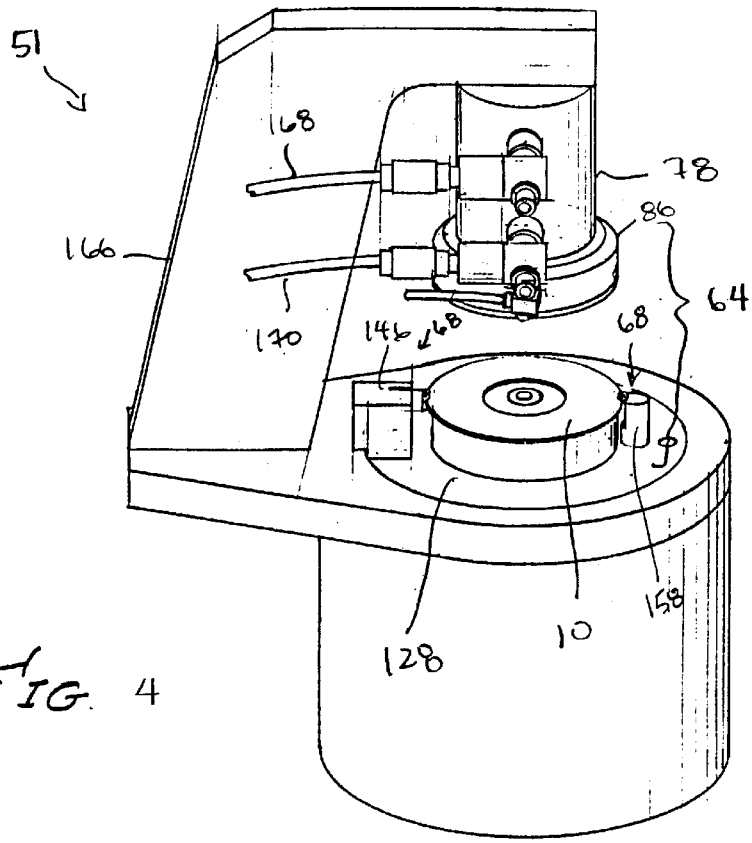
FIG. 4 is a perspective view of an exemplary embodiment of a burnishing unit shown in a disengaged position.
Figure 5:
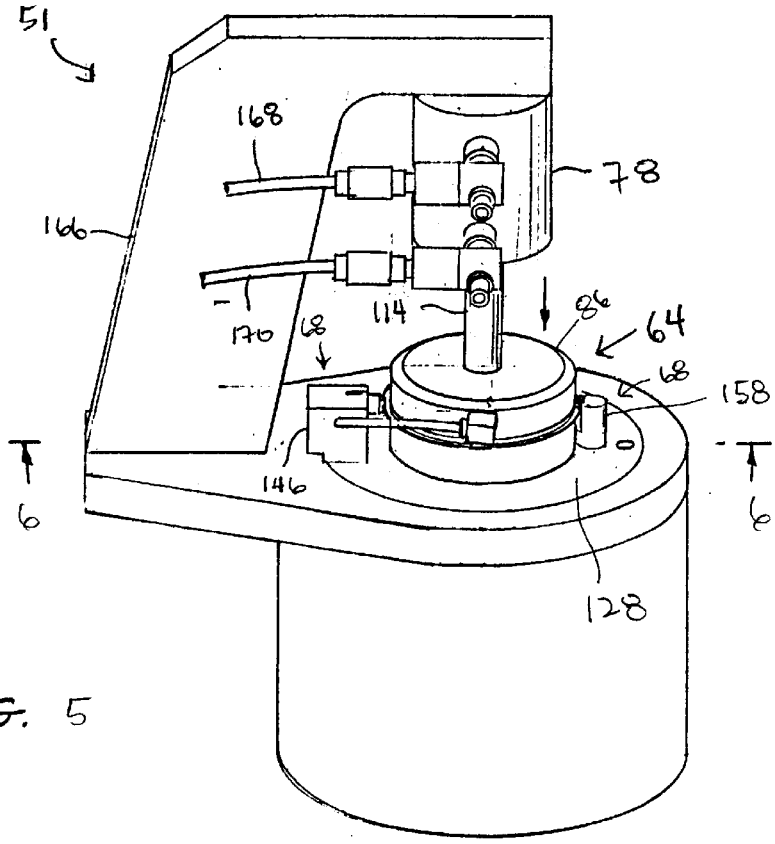
FIG. 5 is a perspective view of the burnishing unit illustrated in FIG. 4 in an engaged position.
Figure 6:
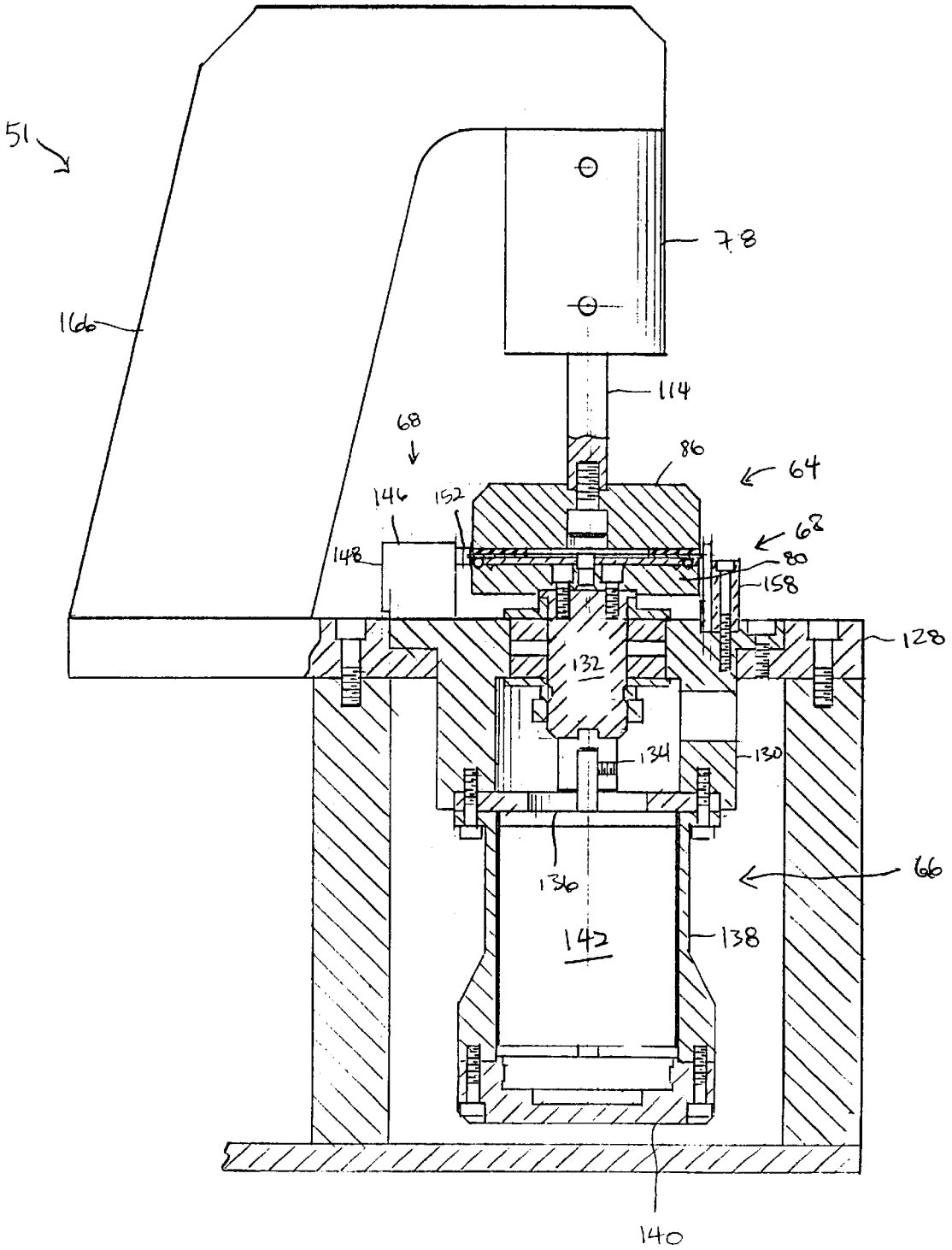
FIG. 6 is a cross-sectional view of the burnishing unit along line 6—6 of FIG. 5.

Referring to FIGS. 4–6, an exemplary embodiment of the burnishing unit 51 is illustrated. The burnishing unit 51 includes a burnishing assembly 64, a drive unit 66 for rotating the burnishing assembly 64, a positioning/securing unit 68 for properly aligning and securing the slip ring substrate 10 onto the burnishing unit 51, and a pneumatic actuator 78 for directing a predetermined force on the slip ring substrate 10 such that the front side 12 of the slip ring substrate 10 is driven against four burnishing balls 70, 72, 74, 76.

Figure 7:
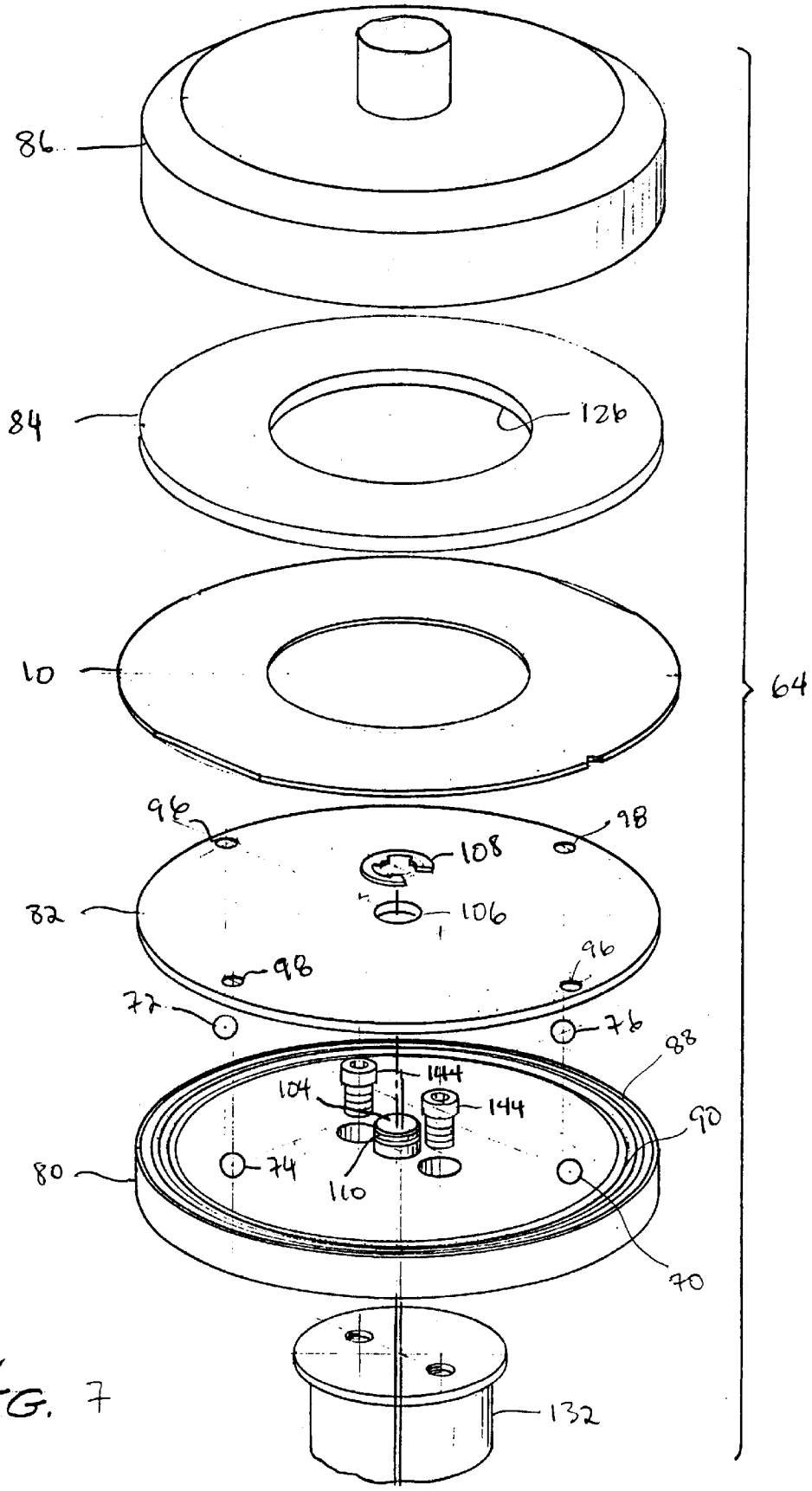
FIG. 7 is an exploded perspective view of a burnishing assembly for the burnishing unit illustrated in FIG. 4.
Figure 8:
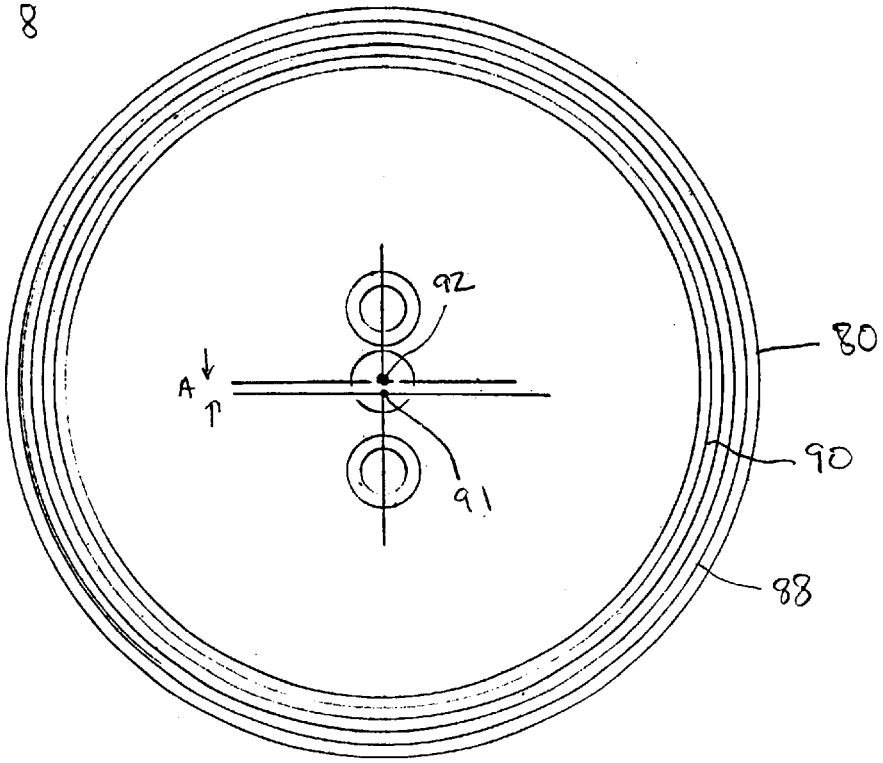
FIG. 8 is a top view of a burnishing disk illustrated in FIG. 7.

Referring to FIG. 7, the burnishing assembly 64 includes a burnishing disk 80, a ball retainer 82, a pressure pad 84, and a top cover 86. Referring to FIG. 8, the burnishing disk 80 has a first 88 and a second annular groove 90 formed near an outer portion of the burnishing disk 80. The first 88 and second groove 90 have a common center axis 91 which is offset from a rotating axis 92 of the burnishing disk 80. The first groove 88 guides the first pair of burnishing balls 70, 72 and the second groove 90 guides the second pair of burnishing balls 74, 76. For the embodiment illustrated in the drawings, the burnishing balls 70, 72, 74, 76 have a diameter of approximately ⅛" and are formed from a high strength material such as tungsten carbide.

Figure 10:
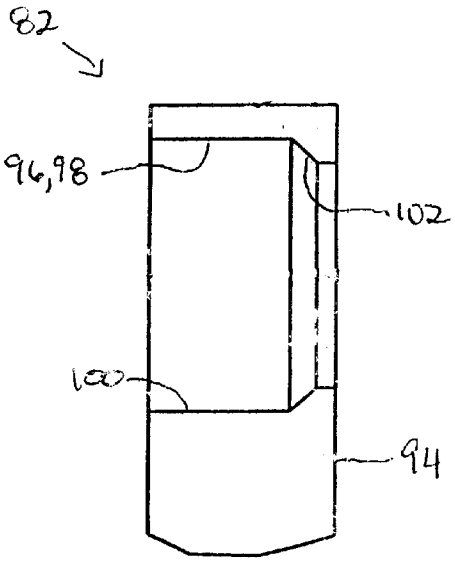
FIG. 10 is an enlarged cross-section view of the ball retainer illustrated in FIG. 7 showing a ball aperture.
Figure 9:
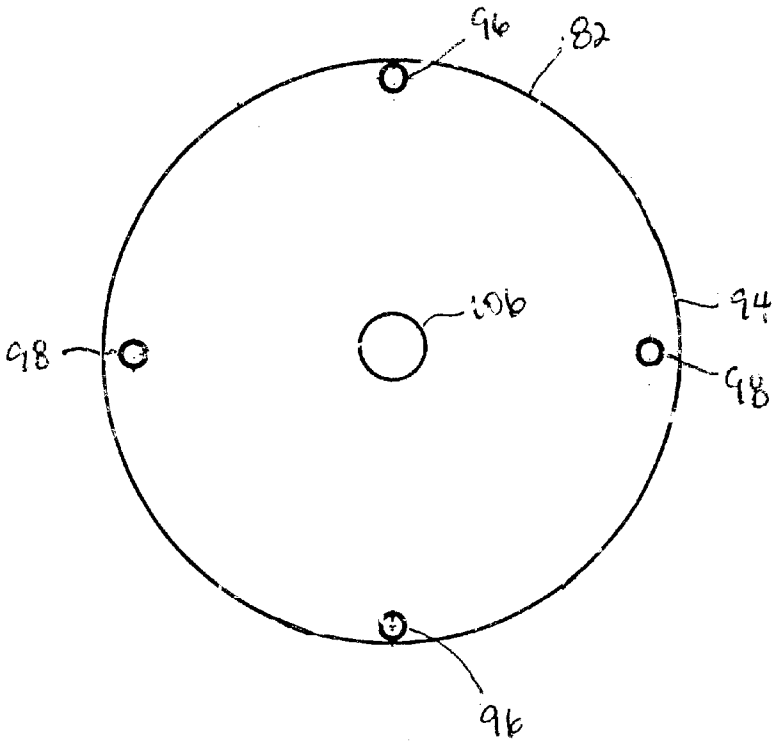
FIG. 9 is a top view of a ball retainer illustrated in FIG. 7.

Referring to FIGS. 9 and 10, the ball retainer 82 is a disk-shaped element 94 having a first 96 and second pair of apertures 98 for retaining the four burnishing balls 70, 72, 74, 76. Each of the apertures 96 in the first pair is spaced 180 degrees apart, and each of the apertures 98 in the second pair is spaced 180 degrees apart. Furthermore, the first pair of apertures 96 is spaced 90 degrees from the second pair of apertures 98 such that each of the four apertures 96, 98 is spaced 90 degrees apart. With the ball retainer 82 positioned directly above the burnishing disk 80, the first pair of apertures 96 is in positional agreement with the first groove 88, and the second pair of apertures 98 is in positional agreement with the second groove 90. Each of the apertures 96, 98 includes a central region 100 which receives a portion of the burnishing ball 70, 72, 74, 76 and a tapered section 102 which prevents the burnishing balls 70, 72, 74, 76 from passing through the aperture 96, 98. The ball retainer 82 is secured to the burnishing disk 80 by a pin/fastener arrangement. The pin/fastener arrangement comprises a pin 104 extending outwardly from a central portion of the burnishing disk 80, and the pin 104 passes through an aperture 106 centrally disposed within the ball retainer 82. By fastening a C-shaped clip 108 onto a groove 110 formed on the pin 104, the ball retainer 82 is secured to the burnishing disk 80. It is noted that the diameter of the aperture 106 is sufficiently larger than the diameter of the pin 104 such that the pin 104 does not restrict movement of the ball retainer 82 in the x and y direction. The ball retainer 82, however, is rotatively coupled to the burnishing disk 80 by the burnishing balls 70, 72, 74, 76 being restricted to track along the first 88 and second groove 90.

The slip ring substrate 10 is positioned such that the front side 12 faces the burnishing balls 70, 72, 74, 76 and the slip ring substrate 10 is secured to the burnishing unit 51 by the positioning/securing unit 68. Additional details of the securing/positioning unit 68 are discussed below. The pneumatic actuator 78 directs the top cover 86 onto the back side 30 of the slip ring substrate 10 and forces the front side 12 onto the burnishing balls 70, 72, 74, 76.

Figure 11A:
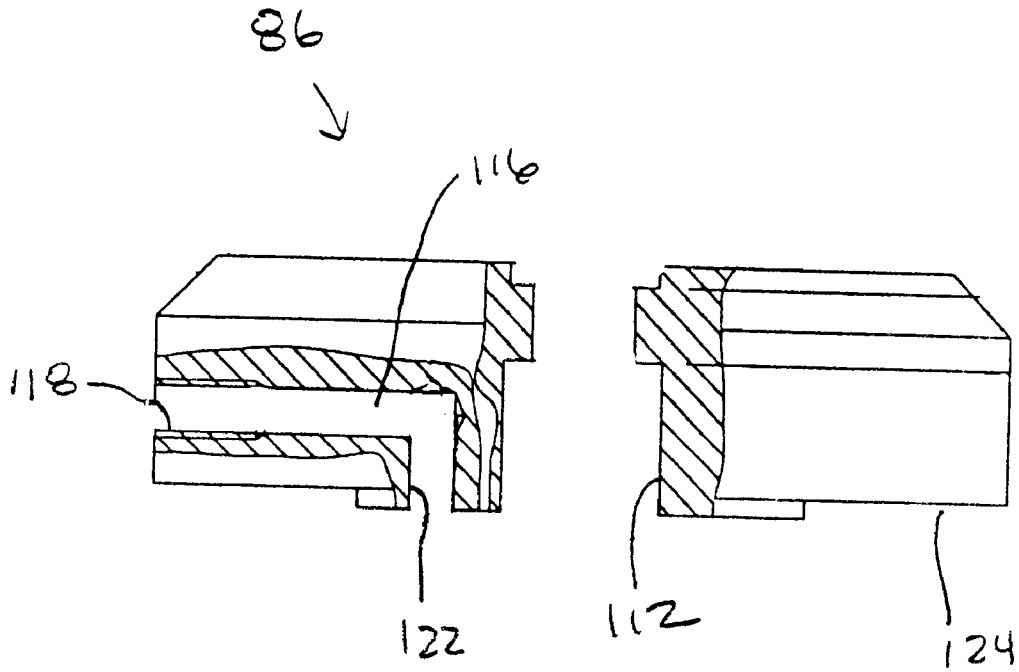
FIG. 11A is a broken view of a top cover with a part in section embodying features of the present invention.
Figure 11B:
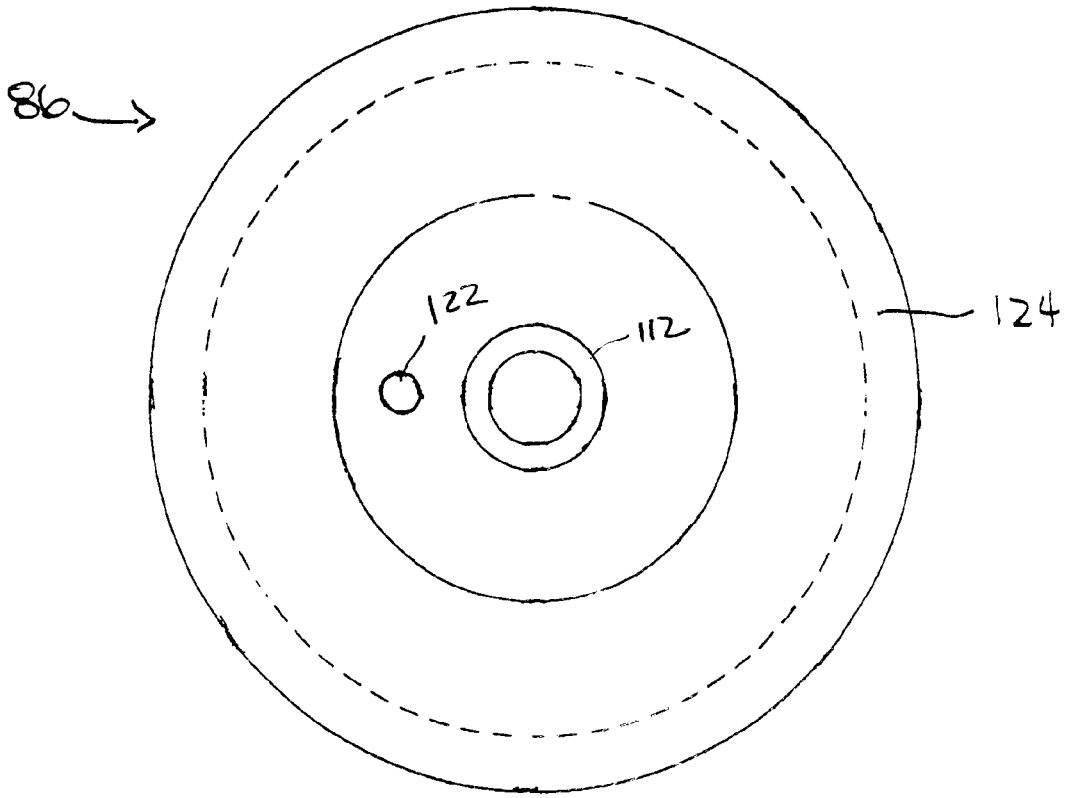
FIG. 11B is a bottom view of the top cover illustrated in FIG. 11A.

Referring to FIGS. 11A and 11B, the top cover 86 has a centrally positioned bore 112 which receives one end of a shaft 114. The other end of the shaft 114 is connected to the pneumatic actuator 78. In order to obtain a smooth and relatively defect free burnished slip ring, it is preferable to remove any contaminant, such as particulates, existing on the front side 12 of the slip ring substrate 10 during the burnishing process. In the embodiment illustrated in the drawings, compressed air is forced through the top cover 86 and directed onto the front side 12 of the slip ring substrate 10 by a passage 116 formed through the top cover 86. The feed end 118 of the passage 116 is located on the circumferential side edge 120 of the top cover 86, and the exit end 122 is located at a bottom face 124 of the top cover 86 near the bore 112. The pressure pad 84 is attached to the bottom face 124 of the top cover 86 and directly contacts the back side 30 of the slip ring substrate 10 when the top cover 86 engages with the slip ring substrate 10. The pressure pad 84 is disk-shaped with a central opening 126 to allow the compressed air to flow through the pressure pad 84 and onto the front side 12 of the slip ring substrate 10. The pressure pad 84 is formed from a resilient material such as a medium hard rubber and provides sufficient contact with the back side 30 of the slip ring substrate 10 to prevent movement of the slip ring substrate 10 during the burnishing process. In addition, the pressure pad 84 is sufficiently soft to avoid damaging the alumina substrate and termination patterns 28.

Referring back to FIG. 6, the drive unit 66 is connected to a base 128 of the burnishing unit 51. The drive unit 66 includes a hub 130, a shaft 132, a coupling 134, a mounting plate 136, a cylinder mount 138, a cup 140 and a motor 142. The base 128 has an opening in which the shaft 132 passes through, and a first end of the shaft 132 is connected to the burnishing disk 80 by two Allen screws 144. The second end of the shaft 132 is connected to the coupling 134, and the coupling 134 is directly connected to a rotating shaft of the motor 142. The shaft 132 and coupling 134 are housed in the hub 130, and the hub 130 is directly connected to the base 128. The cylinder mount 138 is connected to the hub 130 by the mounting plate 136. The motor 142 is housed within the cylinder mount 138, and the lower end of the cylinder mount 138 is covered by the cup 140. As used herein, the term "motor" means any electrical motor which converts AC or DC electrical current into mechanical power. The motor 142 is coupled to the motor controller 58 which comprises a DC controller in which the speed of the motor 142 is voltage governed. It is contemplated that the motor 142 should rotate the burnishing disk 80 at about 120 revolutions per minute. There are other DC controllers available in which the speed of the motor is governed by varying current, by varying both the current and voltage, by solid-state control such as power transistors, power thyristors, or rectifiers, or by various other methods known to one skilled in the art.

Figure 12A:
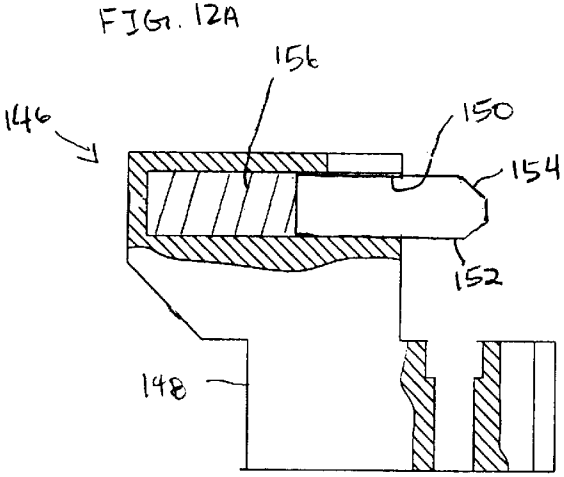
FIG. 12A is a cross-sectional view of a pin locator.
Figure 12B:
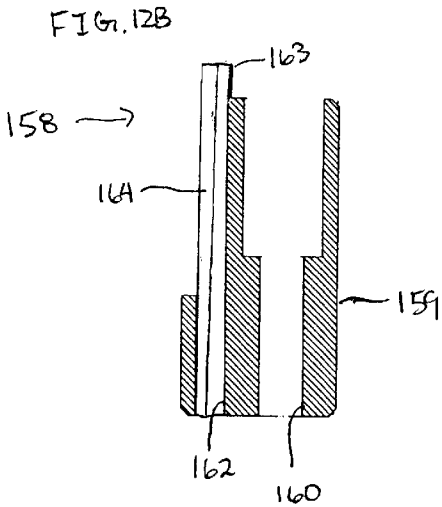
FIG. 12B is a cross-sectional view of a stationary pin locator.

Referring back to FIG. 6, the positioning/securing unit 68 is illustrated. In order for the slip rings 14, 16 to be properly burnished, the slip ring substrate 10 should be properly positioned relative to the burnishing disk 80. Referring to FIG. 12A, the positioning/securing unit 68 includes a pin locator 146 having a substantially rectangular shaped member 148 connected to the base 128 adjacent to the burnishing assembly 64. The rectangular shaped member 148 has a bore 150, and a locking pin 152 with a tapered tip 154 is slidingly received within the bore 150 and extends outwardly under the bias of a spring 156. Referring to FIG. 12B, the positioning/securing unit 68 further includes a stationary pin locator 158 disposed adjacent to the burnishing assembly 64 on the side opposite the pin locator 146. The stationary pin locator 158 is a substantially cylindrical shaped member 159 extending vertically from the surface of the base 128. A main shaft 160 receives a screw for securing the stationary pin locator 158 onto the base 128 of the burnishing assembly 64, and a secondary shaft 162 is disposed near the periphery of the stationary pin locator 158. The secondary shaft 162 has a longitudinal axis parallel to the longitudinal axis of the stationary pin locator 158 and fixedly receives a stationary pin 163. The stationary pin 163 is positioned such that a V-shaped edge 164 along the longitudinal length of the stationary pin 163 faces the burnishing assembly 64.

Referring back to FIG. 6, the pneumatic actuator 78 is disposed above the burnishing assembly 64 and is connected to the base 128 of the burnishing assembly 64 by a cylinder post 166. As discussed above, the lower end of the shaft 12 is connected to the top cover 86 of the burnishing assembly 64. A first 168 and second line 170 connects the compressed air source unit 54 to the pneumatic actuator 78, and the first 168 and second line 170 are respectively coupled to a first and second valve (not shown) for closing and opening the lines 168, 170. The shaft 114 extends vertically outwardly when the first valve is switched to the "open" position, and the compressed air source unit 54 feeds compressed air into the first line 168. The amount of force acting on the slip ring substrate 10 is controlled by regulating the line pressure in the first line 168 via a pressure regulator (not shown). For the exemplary slip ring substrate 10 discussed above, the pneumatic actuator 78 directs a force of approximately 40 lb. onto the slip ring substrate 10 such that each burnishing ball 70, 72, 74, 76 exerts a force of approximately 10 lb. on the front side 12 of the slip ring substrate 10. Of course, the force directed on the slip ring substrate 10 may be increased or decreased by adjusting the pressure regulator. After the slip ring substrate 10 is burnished, the shaft 114 is retracted by switching the first valve to the "closed" position, venting the compressed air in the pneumatic actuator 78, and switching the first valve to the "open" position.

Figure 13:
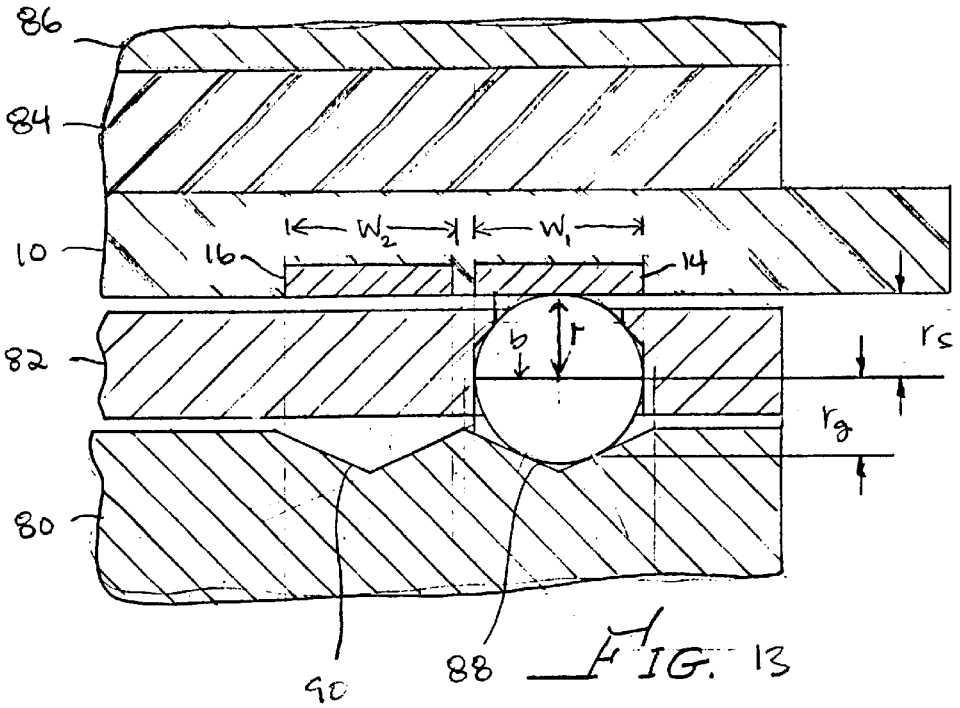
FIG. 13 is an enlarged cross-sectional view of the burnishing assembly illustrated in FIG. 7 showing an effective rolling radius of a ball on a groove and an effective radius of the ball on the slip ring substrate.

Referring to FIG. 13, a cross-sectional view of the first groove 88, second groove 90, and the burnishing ball 70 is illustrated. During the burnishing process, the slip ring substrate 10 remains stationary by being fixedly secured to the base 128 of the burnishing assembly 64. The burnishing ball 70 is disposed between the first groove 88 of the burnishing disk 80 and the front side 12 of the slip ring substrate 10. When the burnishing disk 80 is rotated by the motor 142, the burnishing ball 70 rolls along the first groove 88 and the front side 12 of the slip ring substrate 10 without slippage. The burnishing ball 70 has a radius r, an effective rolling radius on the slip ring substrate $r_s$, an effective rolling radius on the burnishing disk $r_g$, and an angular rotation ω. As the burnishing ball 70 tracks along the first groove 88, it rotates substantially about an axis b with the angular rotation ω. Since r is equal to $r_s$ and r is greater than $r_g$, the angular traverse of the burnishing ball 70 on the slip ring substrate ϕ is greater than the angular traverse of the burnishing ball 70 on the first groove $\phi_g$.

During operation of the burnishing assembly 64, it can be observed that the burnishing disk 80 rotates at a greater rate than the ball retainer 82. It is noted that the same principles apply to the other burnishing balls 72, 74, 76 and the second groove 90. Due to the combined effects of 1) the center axis 91 of the first 88 and second groove 90 being offset from the rotating axis 92 of the burnishing disk 80 by a distance A and 2) r being greater than $r_g$, each of the burnishing balls 70, 72, 74, 76 forms a variable path such that the tracks of the burnishing balls w cover the entire surface of the slip rings 14, 16 after N revolutions of the burnishing balls 70, 72, 74, 76.

The width of each slip ring W and mean radius of the slip ring R are determined by the design considerations of the slip ring substrate. In the exemplary slip ring substrate 10 described above, the first slip ring 14 has a mean radius $R_1$ and a width $W_1$, and the second slip ring 16 has a mean radius $R_2$ and a width $W_2$. The width $W_1$ of the first slip ring 14 is equal to the width $W_2$ of the second slip ring 16.

Figure 14:
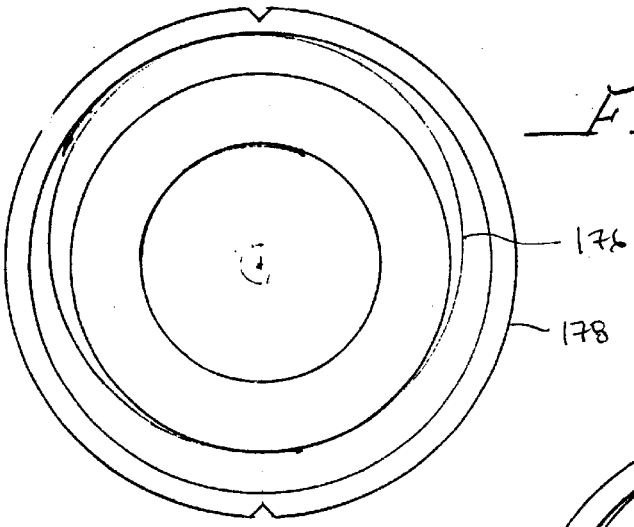
FIG. 14 is a top view of a slip ring substrate showing a track left on the surface after a single revolution of a ball around the slip ring substrate.
Figure 15:
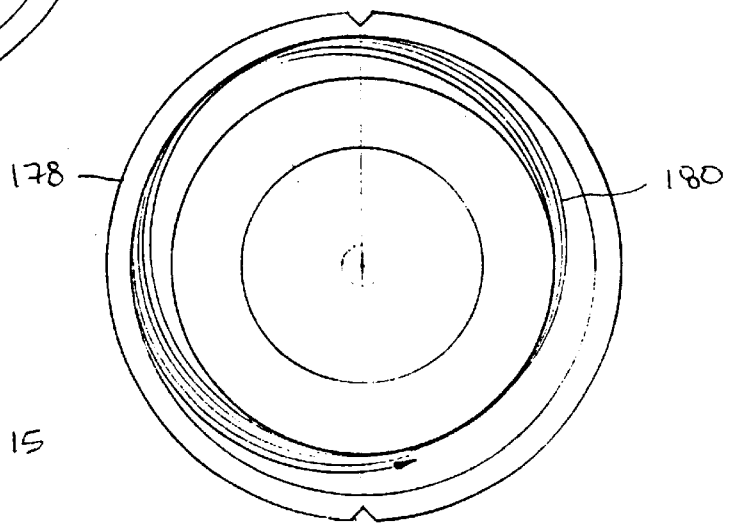
FIG. 15 is a top view of the slip ring substrate illustrated in FIG. 14 showing a track left of the surface after five revolutions.

FIG. 14 illustrates a track 176 left on a substrate 178 by a burnishing ball after one revolution, and FIG. 14 illustrates a track 180 left on the substrate 178 by the burnishing ball after five revolutions. For the sake of simplicity, the tracks 176, 180 illustrated in FIGS. 14 and 15 are formed from a simplified burnishing assembly having a burnishing disk with a single groove and a single burnishing ball (it is noted that the preferred embodiment illustrated above comprises a burnishing disk having two grooves with each of the grooves having a pair of burnishing balls). When $r_g<r$ and the central axis of the groove is offset from the rotating axis of the burnishing disk, the burnishing disk is slightly offset angularly from the original position when the burnishing ball first returns to the original position relative to the substrate 178. Thus, the track comprises paths which are nearly adjacent to each other because the burnishing disk is slightly offset angularly and the burnishing ball is at a slightly different radius. This process continues until the accumulation of offsets is nearly one full revolution (or a multiple thereof), whence the pattern nearly repeats. The non-exactness of the physical elements may give a non-exact retracing of track at the predicted number of revolutions.

In order to completely burnish the width of the slip ring W, A is usually W/2. The mean radius of the groove $R_g$ is preferably sized to be equivalent to the mean radius of the slip ring R. N is the number of revolutions the burnishing ball must travel to track the entire W, and N is a function of the track width w left by the burnishing ball. Usually, N is selected so that N·w is greater than W, and $r_g$ is determined by N. Presuming the burnishing ball rolls without slipping on the substrate 178, $$\omega \cdot r = \phi \cdot R \tag{1}$$

Similarly, presuming the burnishing ball rolls without slipping on the groove of the burnishing disk, $$\omega \cdot r_g = \phi_g \cdot R \tag{2}$$

Dividing equation (2) by equation (1) leaves $$r_g/r = \phi_g/\phi \tag{3}$$

$$\phi_g = (r_g/r)\phi \tag{3b}$$

If N is smallest positive integer such that $N(r_g/r)$ is an integer m, then when ϕ=N revolutions (i.e. $\phi=2\tau N$), it follows by equation (3b) that $\phi_g = m \cdot 2\tau$. With the burnishing ball having traveled an integer number of revolutions with respect to both the burnishing disk and the substrate 178, the relative locations must be identical to the starting position. For this reason, the groove is designed so that $(r_g/r)=(1-1/N)$ where N is the desired number of revolutions to complete the burnishing path. If N is the number of revolutions of the burnishing ball with respect to the substrate 178 and m is the number of revolutions of the burnishing ball with respect to the burnishing disk, then the number of revolutions of the burnishing disk with respect to the substrate 178 is N+m. In the embodiment illustrated in FIGS. 4–13, r=0.0625", $r_g \cong 0.05625$", A=0.0240", W=0.048", $N=-(r_g/r-1)^{-1}=10$.

The present invention shown in FIGS. 4–13 operates in the following manner. Assuming the top cover 86 is in the disengaged position, the first valve is in the "closed" position, and the second valve is in the "open" position. The slip ring substrate 10 is positioned on the burnishing balls 70, 72, 74, 76 with the front side 12 of the substrate facing the burnishing balls 70, 72, 74, 76. A first V-shaped notch 182 of the slip ring substrate 10 is engaged with the tapered tip 154 of the locking pin 152, and the slip ring substrate 10 is forced against the bias of the spring 156 to partially retract the locking pin 152 into the bore 150. The second V-shaped notch 184 of the slip ring substrate 10 is engaged with the V-shaped edge 164 of the stationary pin 163, and the slip ring substrate 10 remains secured to the burnishing assembly 64 under the bias of the spring 156.

For the slip ring substrate 10 described above, the load selector 56 is set at 40 lbs., the motor controller 58 is set at 120 revolutions per minute, and the revolution selector 60 is set at 20 revolutions. If the slip rings 14, 16 are not sufficiently smooth after the burnishing process, the settings may be altered. The pneumatic actuator 78 is set to the engaged position, wherein the first valve is switched from the normally "closed" position to the "open" position. The shaft 114 extends outwardly and the top cover 86 engages with the back side 30 of the slip ring substrate 10. At this stage, the slip ring substrate 10 is directed against the burnishing balls 70, 72, 74, 76 at a force of 10 lbs. per burnishing ball 70, 72, 74, 76. In addition, the slip ring substrate 10 is further prevented from moving in the x and y direction by the contact resistance of the pressure pad 84.

Compressed air is forced through the top cover 86 and directed onto the front side 12 of the slip ring substrate 10. The motor 142 is energized and the burnishing disk 80, ball retainer 82, and burnishing balls 70, 72, 74, 76 rotate relative to the slip ring substrate 10. The motor 142 is automatically switched "off" after completing 20 revolutions. After completion of the 20 revolutions, the pneumatic actuator 78 is set to the disengaged position, wherein the first valve is switched from the "open" position to the "closed" position, the compressed air is vented, and the second valve is switched from the "closed" position to the "open" position. The shaft 114 is retracted, and the top cover 86 disengages from the back side 30 of the slip ring substrate 10. The slip ring substrate 10 may be removed from the burnishing assembly 64 by forcing the slip ring substrate 10 against the bias of the spring 156 to partially retract the locking pin 152 into the bore 150 and disengaging the second V-shaped notch 184 of the slip ring substrate 10 from the V-shaped edge 164 of the stationary pin 163.

Although the present invention has been described in detail with regarding the exemplary embodiments and drawings thereof, it should be apparent to those skilled in the art that various adaptations may be accomplished without departing from the spirit and scope of the invention. For example, instead of fixing the slip ring substrate and rotatively driving the burnishing disk, the burnishing disk may be fixedly secured and the slip ring substrate may be rotated by a motor. Further, the burnishing assembly may comprise more than four burnishing balls. Additional burnishing balls may be preferable when a large surface must be burnished or if the material to be burnished is relatively hard. Still further, r does not have to equal $r_2$. The present invention operates as long as $r_1$ is not equal to $r_2$. Accordingly, the invention is not limited to the precise embodiment shown in the drawings and described in detail hereinabove.

What is claimed is:

1. A burnishing apparatus for burnishing a first surface of a material, comprising:

a disk having a face, said disk rotating about an axis;

a first annular groove disposed near an outer portion of said disk, said first annular groove being eccentric to said axis of said disk;

a second annular groove having a diameter less than a diameter of said first annular groove, said second annular groove disposed adjacent to said first annular groove, said second annular groove being concentric with said first annular groove;

at least two rolling elements disposed between said first annular groove and said first surface of said material; and at least two additional rolling elements disposed between said second annular groove and said first surface of said material;

wherein said at least two rolling elements and said at least two additional rolling elements leave tracks on said first surface of said material, and said tracks repeating after said at least two rolling elements and said at least two additional rolling elements complete N revolutions about said first surface of said material.

2. The burnishing apparatus of claim 1, further comprising a retainer being disk-shaped and having a first pair of apertures and a second pair of apertures, said first pair of apertures receiving said at least two rolling elements, said second pair of apertures receiving said at least two additional rolling elements, said retainer maintaining said at least two rolling elements and said at least two additional rolling elements at a fixed position relative to each other.

3. The burnishing apparatus of claim 1, further comprising a motor coupled to said disk to rotate said disk.

4. The burnishing apparatus of claim 1, further comprising a top cover contacting a second surface of said material, said top cover forcing said first surface of said material onto said at least two rolling elements and said at least two additional rolling elements.

5. The burnishing apparatus of claim 4, further comprising a pressure pad disposed between said top cover and said second surface of said material, said pressure pad protecting said second surface of said material and fixedly securing said material.

6. The burnishing apparatus of claim 3, further comprising:

a top cover; and an actuator connected to said top cover;

wherein said actuator directs said top cover onto a second surface of said material, said top cover forcing said first surface of said material onto said at least two rolling elements and said at least two additional rolling elements; and wherein said top cover includes a passage for directing a compressed gas onto said first surface of said material for cleaning said first surface of said material.

7. The burnishing apparatus of claim 6, wherein said actuator is a pneumatic actuator, said pneumatic actuator directing a predetermined force on the material.

8. The burnishing apparatus of claim 7, further comprising:

a base;

wherein said disk being rotatively coupled to said base;

a positioning/securing unit coupled to said base, said positioning/securing unit fixedly securing said material onto said base;

a compressed air source coupled to said pneumatic actuator to drive said pneumatic actuator; and a control unit coupled to said motor and said pneumatic actuator.

9. The burnishing apparatus of claim 1, wherein said at least two rolling elements and said at least two additional rolling elements are balls.

10. The burnishing apparatus of claim 2, wherein said first pair of apertures are 180 degrees apart and said second pair of apertures are 180 degrees apart.

11. A burnishing apparatus for burnishing a surface of a material, comprising:

a guide member rotating about an axis relative to said material, said guide member having a face, said face having an annular groove, said groove being eccentric to said rotating axis of said guide member;

a rolling element disposed between said groove and said surface of said material;

an additional annular groove on said face of said guide member, said additional annular groove having a diameter less than the diameter of said annular groove, said additional groove being concentric with said annular groove; and an additional rolling element disposed between said additional annular groove and said surface of said material, said additional rolling element leaving an additional track on said surface of said material when rolling on said additional annular groove and said surface of said material.

12. The burnishing apparatus of claim 11 wherein said annular groove has at least two of said rolling elements and said additional annular groove has at least two of said additional rolling elements.

13. The burnishing apparatus of claim 12, further comprising a retainer having a plurality of apertures, said apertures receiving at least two said rolling elements and at least two said additional rolling elements and maintaining at least two said rolling elements and at least two said additional rolling elements at a fixed position relative to each other.

14. The burnishing apparatus of claim 13, wherein said guide member and said retainer are disk shaped, and said retainer is disposed between said guide member and said material.

15. The burnishing assembly of claim 14, wherein said guide member rotates at about twice the rate of said retainer.

* * * * *